US010520879B2

(12) United States Patent
Kiriyama

(10) Patent No.: US 10,520,879 B2
(45) Date of Patent: Dec. 31, 2019

(54) DEVELOPING CARTRIDGE INCLUDING ELECTRODE TO WHICH ADAPTER IS DETACHABLY ATTACHABLE

(71) Applicant: BROTHER KOGYO KABUSHIKI KAISHA, Nagoya-shi, Aichi-ken (JP)

(72) Inventor: Tsubasa Kiriyama, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/249,017

(22) Filed: Jan. 16, 2019

(65) Prior Publication Data

US 2019/0302679 A1 Oct. 3, 2019

(30) Foreign Application Priority Data

Mar. 28, 2018 (JP) ..... 2018-062225

(51) Int. Cl.

| | |
|---|---|
| ***G03G 15/06*** | (2006.01) |
| ***G03G 21/00*** | (2006.01) |
| ***G03G 21/16*** | (2006.01) |
| ***G03G 15/08*** | (2006.01) |

(52) U.S. Cl.

CPC ..... *G03G 21/1652* (2013.01); *G03G 15/0865* (2013.01)

(58) Field of Classification Search

CPC ..... G03G 15/0865; G03G 21/1652; G03G 21/1676; G03G 21/1867

See application file for complete search history.

(56) References Cited

U.S. PATENT DOCUMENTS 5,857,129 A * 1/1999 Harris ..... G03G 15/0865 399/12
2013/0084084 A1* 4/2013 Itabashi ..... G03G 21/1867 399/12

FOREIGN PATENT DOCUMENTS

JP 2018-5177 A 1/2018

* cited by examiner

*Primary Examiner* — Sophia S Chen

(74) *Attorney, Agent, or Firm* — Merchant & Gould P.C.

(57) ABSTRACT

A developing cartridge includes a developing roller rotatable about a first axis extending in an axial direction of the developing roller, a casing having an outer surface positioned at one end of the casing in the axial direction, an electrode electrically connected to the developing roller and positioned at the outer surface, the electrode extending in the axial direction, a gear, a protrusion, and an adapter having an electric conductivity and detachably attachable to the electrode, the adapter being electrically connected to the electrode in a state where the adapter is attached to the electrode. A total length of the electrode and the adapter in the axial direction in the state where the adapter is attached to the electrode is greater than a length in the axial direction of the electrode in a state where the adapter is detached from the electrode.

6 Claims, 5 Drawing Sheets

DEVELOPING CARTRIDGE INCLUDING ELECTRODE TO WHICH ADAPTER IS DETACHABLY ATTACHABLE

CROSS REFERENCE TO RELATED APPLICATION

This application claims priority from Japanese Patent Application No. 2018-062225 filed Mar. 28, 2018. The entire content of the priority application is incorporated herein by reference.

TECHNICAL FIELD

The present disclosure relates to a developing cartridge.

BACKGROUND

There is conventionally known a first type of developing cartridge providing a first specification and compatible with and attachable to a first type of image forming apparatus, and a second type of developing cartridge providing a second specification and compatible with and attachable to a second type of image forming apparatus as described in a prior art. The first type of developing cartridge cannot be attached to the second type of image forming apparatus, and the second type of developing cartridge cannot be attached to the first type of image forming apparatus.

SUMMARY

Here, a demand may occur to provide a developing cartridge compatible with and attachable to the first type of image forming apparatus as well as to the second type of image forming apparatus.

In view of the foregoing, it is an object of the disclosure to provide a developing cartridge capable of being attached to both first and second types of image forming apparatus.

In order to attain the above and other objects, according to one aspect, the disclosure provides a developing cartridge including a developing roller, a casing, an electrode, a gear, a protrusion, and an adapter. The developing roller is rotatable about a first axis extending in an axial direction of the developing roller. The casing is configured to accommodate therein toner. The casing has an outer surface positioned at one end of the casing in the axial direction. The electrode is electrically connected to the developing roller and positioned at the outer surface. The electrode extends in the axial direction. The gear is rotatable about the electrode. The protrusion protrudes in the axial direction and is rotatable together with the gear. The adapter has an electric conductivity and is detachably attachable to the electrode. The adapter is electrically connected to the electrode in a state where the adapter is attached to the electrode. A total length of the electrode and the adapter in the axial direction in the state where the adapter is attached to the electrode is greater than a length in the axial direction of the electrode in a state where the adapter is detached from the electrode.

According to another aspect, the disclosure provides a developing cartridge including a main portion and an adapter. The main portion includes a developing roller, a casing, an electrode, a gear, and a protrusion. The developing roller is rotatable about a first axis extending in an axial direction of the developing roller. The casing is configured to accommodate therein toner. The casing has an outer surface positioned at one end of the casing in the axial direction. The electrode is electrically connected to the developing roller and positioned at the outer surface. The electrode extends in the axial direction. The gear is rotatable about the electrode. The protrusion protrudes in the axial direction and is rotatable together with the gear. The adapter has an electric conductivity and is detachably attachable to the electrode. The adapter is electrically connected to the electrode in a state where the adapter is attached to the electrode. A total length of the electrode and the adapter in the axial direction in the state where the adapter is attached to the electrode is greater than a length in the axial direction of the electrode in a state where the adapter is detached from the electrode. The adapter is detached from the electrode to attach the main portion to the first type of image forming apparatus, and the adapter is attached to the electrode to attach the main portion to the second type of image forming apparatus.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Figure 1:
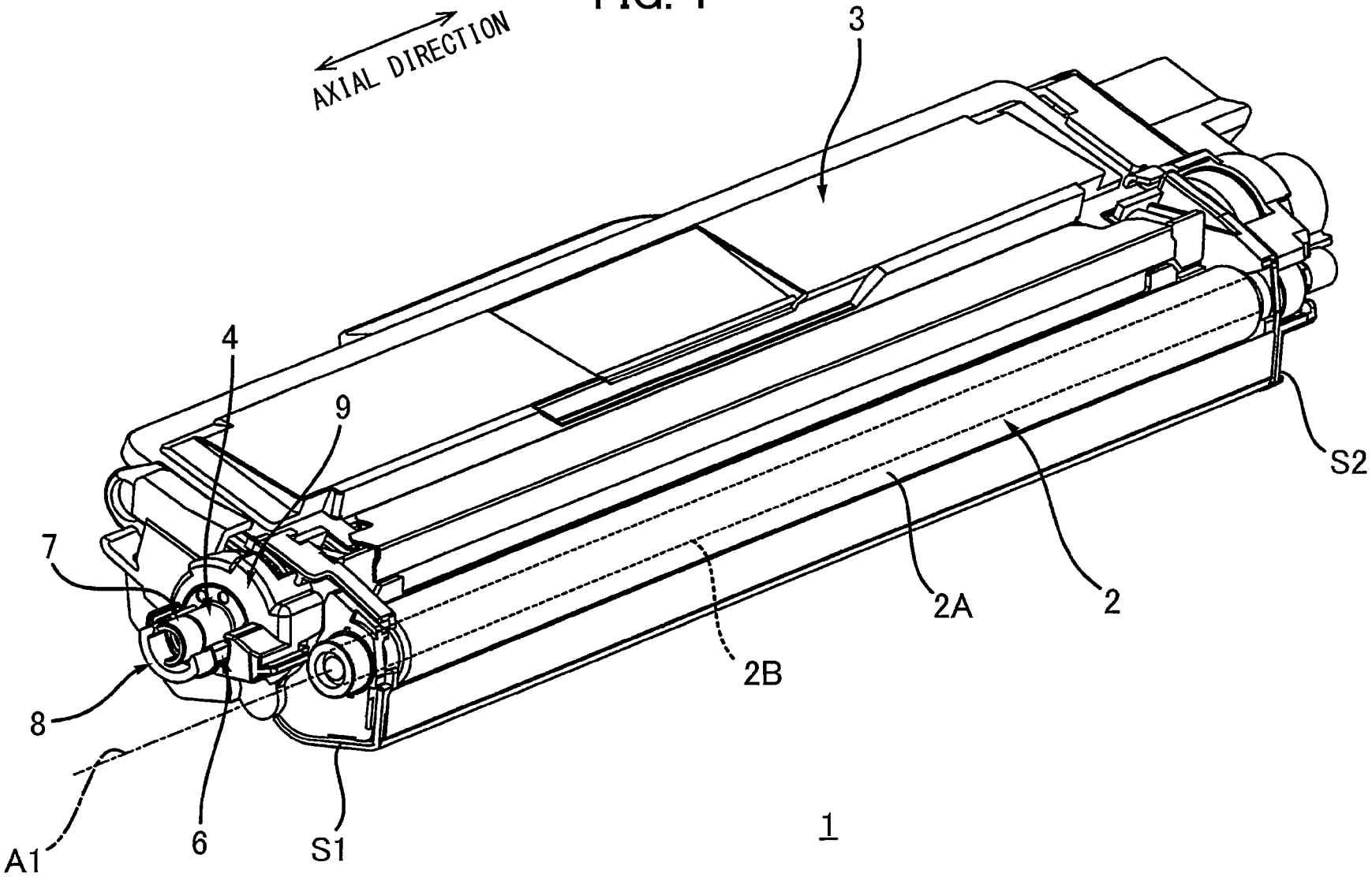
FIG. 1 is a perspective view of a developing cartridge according to one embodiment.

A developing cartridge 1 according to one embodiment will be described with reference to FIGS. 1 through 4B. The developing cartridge 1 includes a developing roller 2, a casing 3, a bearing 10 (See FIG. 3), an electrode 4, an agitator gear 11 (see FIG. 3), a gear 5 (see FIG. 3), a protrusion 6, an adapter 7, a second adapter 8, and a gear cover 9.

1.1 Developing Roller 2

As illustrated in FIG. 1, the developing roller 2 is rotatable about a first axis A1 extending in an axial direction. The developing roller 2 includes a developing roller body 2A, and a developing roller shaft 2B.

The developing roller body 2A is cylindrical in shape extending in the axial direction. The developing roller body 2A is made from electrically conductive rubber. The developing roller body 2A has a part exposed to an outside from the casing 3.

The developing roller shaft 2B is cylindrical in shape extending along the first axis A1. The developing roller shaft 2B is made from metal. The developing roller shaft 2B extends through the developing roller body 2A in the axial direction, and is positioned inside the developing roller body 2A in a radial direction of the developing roller body 2A. Incidentally, the developing roller shaft 2B may not extend through a length of the developing roller body 2A in the axial direction. Instead, a developing roller shaft 2B may be attached to each end of the developing roller body 2A in the axial direction. The developing roller 2 is rotatable about an axis of the developing roller shaft 2B.

1.2 Casing 3

The casing 3 is configured to accommodate therein toner. The casing 3 has a box shape extending in the axial direction. The casing 3 has an outer surface S1 positioned at one end of the casing 3 in the axial direction, and an outer surface S2 positioned at another end of the casing 3 in the axial direction.

1.3 Bearing 10

Figure 3:
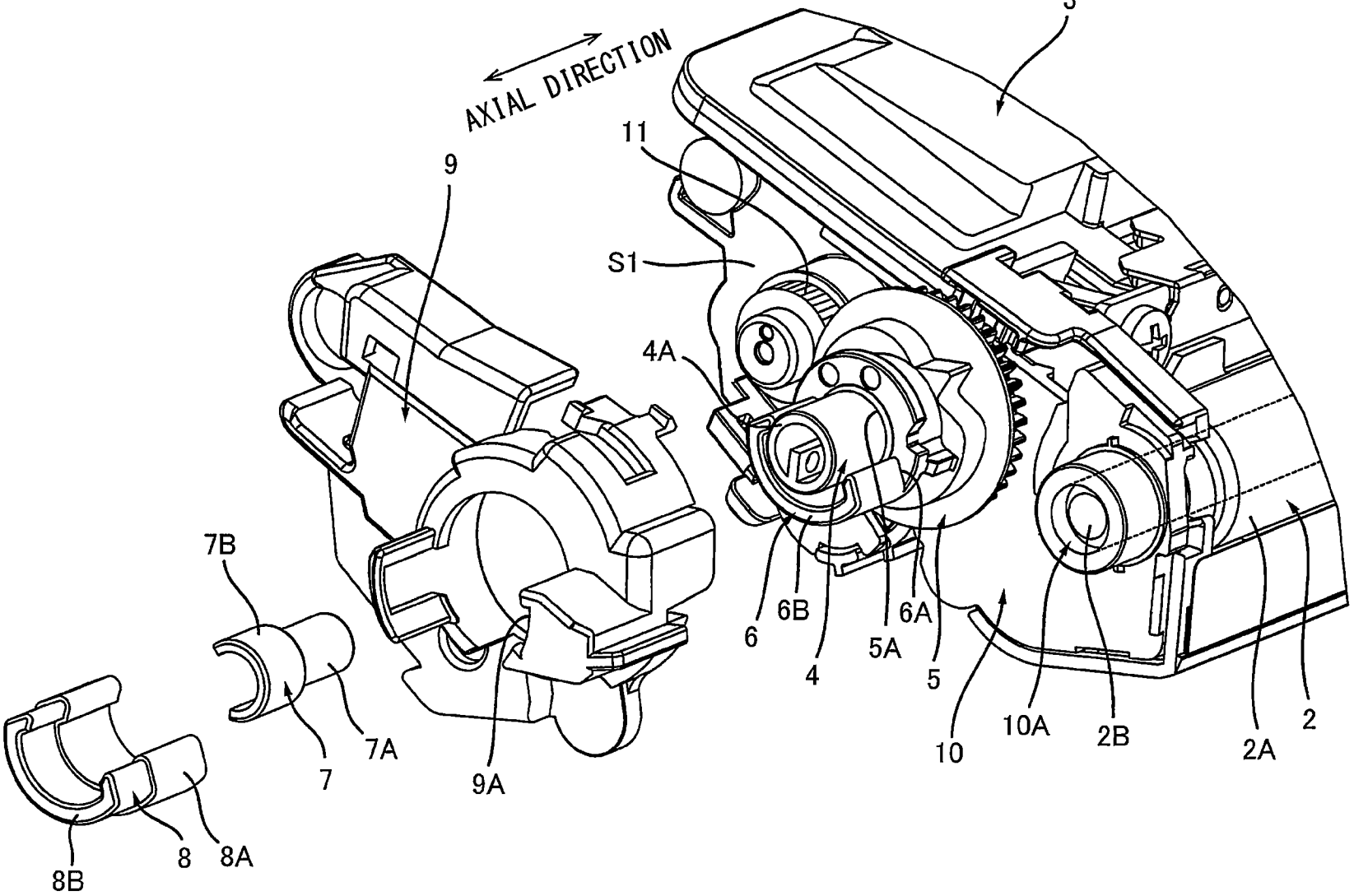
FIG. 3 is an exploded view illustrating the end portion of the developing cartridge illustrated in FIG. 2 according to the embodiment.

As illustrated in FIG. 3, the bearing 10 is positioned at the outer surface S1. The bearing 10 has a through-hole 10A in which the developing roller shaft 2B is inserted. Thus, the bearing 10 rotatably supports the developing roller shaft 2B. The bearing 10 is made from electrically conductive resin. Thus, the bearing 10 is electrically connected to the developing roller shaft 2B in the state where the bearing 10 rotatably supports the developing roller shaft 2B.

1.4 Electrode 4

The electrode 4 is positioned at the outer surface S1 and is electrically connected to the developing roller 2. Specifically, the electrode 4 is made from electrically conductive resin and extends from the bearing 10 in the axial direction. Hence, electric power received in the electrode 4 is applied to the developing roller 2 through the bearing 10. The electrode 4 is hollow cylindrical in shape, and has a base end portion connected to the bearing 10 and a free end portion 4A away from the bearing 10 in the axial direction. The base end portion is not illustrated in the drawings.

Figure 4A:
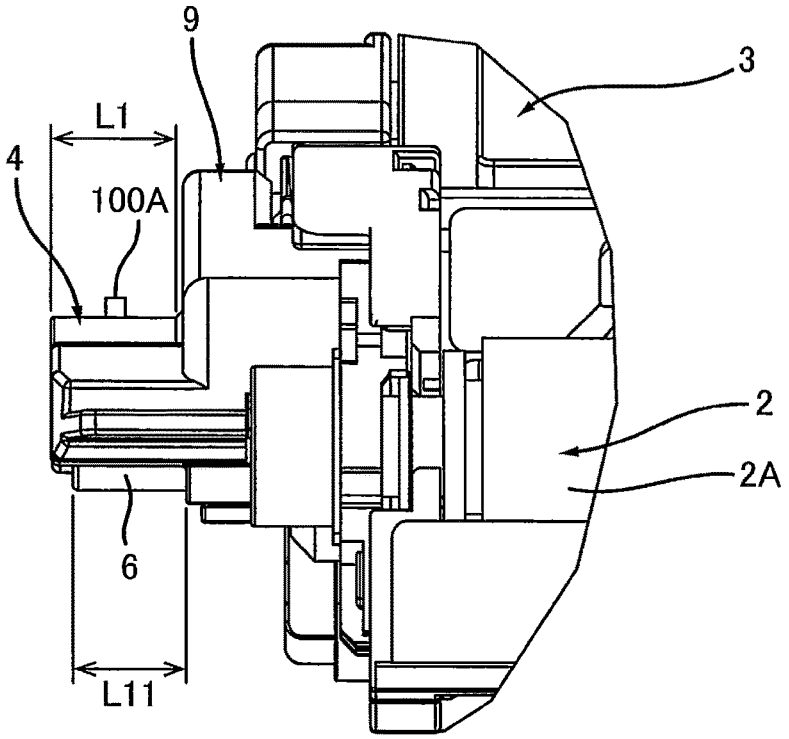
FIG. 4A is a view illustrating a state where the developing cartridge according to the embodiment is attached to a first type of image forming apparatus such that first and second adapters 7 and 8 are detached from an electrode 4 and a protrusion 6, respectively.
Figure 5A:
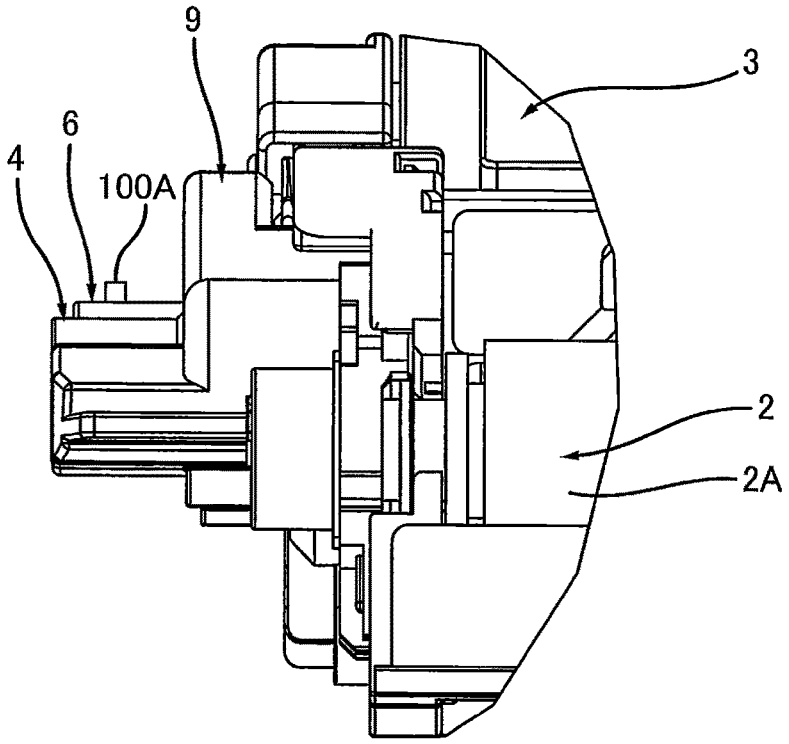
FIG. 5A is a view illustrating a state where the protrusion 6 of the developing cartridge illustrated in FIG. 4A is rotated about the electrode 4.

A first type of image forming apparatus having a first specification has a first main electrode 100A and the electrode 4 is in contact with the first main electrode 100A in a state of attachment of the developing cartridge 1 to the first type of image forming apparatus as illustrated in FIG. 4A. The first main electrode 100A is positioned at an inner portion of the first type of image forming apparatus. The electrode 4 is in contact with the first main electrode 100A in a state of attachment of the developing cartridge 1 to the first type of image forming apparatus. Hence, the electrode 4 can receive electric power from the first type of image forming apparatus in the state of the attachment of the developing cartridge 1 to the first type of image forming apparatus. Incidentally, the first main electrode 100A is movable from a contact position (FIG. 4A) in contact with the electrode 4 to a separate position (FIG. 5A) away from the electrode 4 by pressing force from the protrusion 6 rotatable about the electrode 4 (described later).

1.5 Agitator Gear 11

As illustrated in FIG. 3, the agitator gear 11 is positioned at the outer surface S1 of the casing 3. The agitator gear 11 is attached to an agitator (not illustrated) positioned inside the casing 3. The agitator rotates upon receiving driving force from the image forming apparatus through a coupling (not illustrated) and a gear train (not illustrated) which are positioned at the outer surface S2. Rotation of the agitator causes agitation of toner accommodated in the casing 3. The agitator gear 11 is rotatable together with the agitator.

1.6 Gear 5

As illustrated in FIG. 3, the gear 5 is positioned at the outer surface S1. The gear 5 is coaxial with and rotatable relative to the electrode 4. Specifically, the gear 5 has a through-hole 5A in which the electrode 4 is inserted. Thus, the gear 5 is rotatable about the electrode 4. The gear 5 is meshingly engageable with the agitator gear 11. The gear 5 is a partly tooth lacking gear including a teeth portion and a toothless portion. Rotation of the gear 5 occurs by the meshing engagement between the teeth portion with the agitator gear 11, and rotation of the gear 5 is stopped by disengagement of the teeth portion from the agitator gear 11 in the state of attachment of the developing cartridge 1 to the image forming apparatus.

1.7 Protrusion 6

The protrusion 6 is rotatable together with the gear 5. The protrusion 6 protrudes from the gear 5 in the axial direction. The protrusion 6 has a base end portion 6A connected to the gear 5 and a tip end portion 6B away from the gear 5 in the axial direction. The protrusion 6 extends in a rotational direction of the gear 5.

The developing cartridge 1 is initially attached to the first type of image forming apparatus as illustrated in FIG. 4A in which the electrode 4 is in contact with the first main electrode 100A of the first type of image forming apparatus. Then rotation of the gear 5 causes rotation of the protrusion 6, so that the protrusion 6 is brought into contact with the first main electrode 100A, and the first main electrode 100A is pushed by the protrusion 6 and moves from the position illustrated in FIG. 4A to the position illustrated in FIG. 5A. The first type of image forming apparatus includes a sensor (not illustrated) configured to detect movement of the first main electrode 100A. The first type of image forming apparatus can determine information on the developing cartridge 1, such as whether or not the cartridge is a new cartridge, and printable numbers of sheets on a basis of a signal pattern transmitted from the sensor. In this embodiment, a single protrusion 6 is used. However, a plurality of protrusions may also be available. In the latter case, the protrusions are arrayed in the rotating direction of the gear 5 with a space between neighboring protrusions. A combination of the developing roller 2, the casing 3, the electrode 4, the gear 5, and the protrusion 6 is an example of a main portion.

1.8 First Adapter 7

The adapter 7 is an auxiliary tool for applying electric power from a second type of image forming apparatus to the electrode 4 in the state of attachment of the developing cartridge 1 to the second type of image forming apparatus. The second type of image forming apparatus provides a second specification different from the first specification of the first type of image forming apparatus.

Figure 4B:
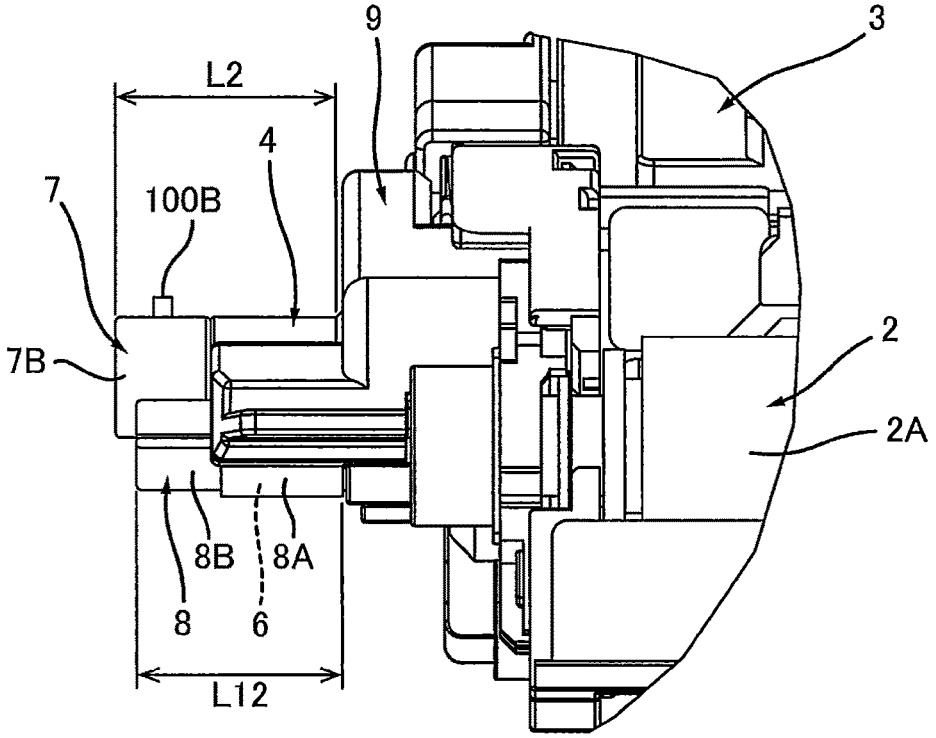
FIG. 4B is a view illustrating a state where the developing cartridge according to the embodiment is attached to a second type of image forming apparatus such that the first and second adapters 7 and 8 are attached to the electrode 4 and the protrusion 6, respectively.

The second type of image forming apparatus is provided with a second main electrode 100B as illustrated in FIG. 4B. The second main electrode 100B is positioned at an inner portion of the second type of image forming apparatus. The second main electrode 100B is movable from a contact position (FIG. 4B) in contact with the adapter 7 to a separate position (FIG. 5B) separated from the adapter 7 by the pressing force from the second adapter 8 rotatable together with the protrusion 6. The developing cartridge 1 is initially attached to the second type of image forming apparatus as illustrated in FIG. 4B in which the second main electrode 100B is separated from the electrode 4 and the protrusion 6 in the axial direction. Thus, in the initially attaching state of the developing cartridge 1 to the second type of image forming apparatus, the second main electrode 100B is out of contact with the electrode 4 and the protrusion 6.

Figure 2:
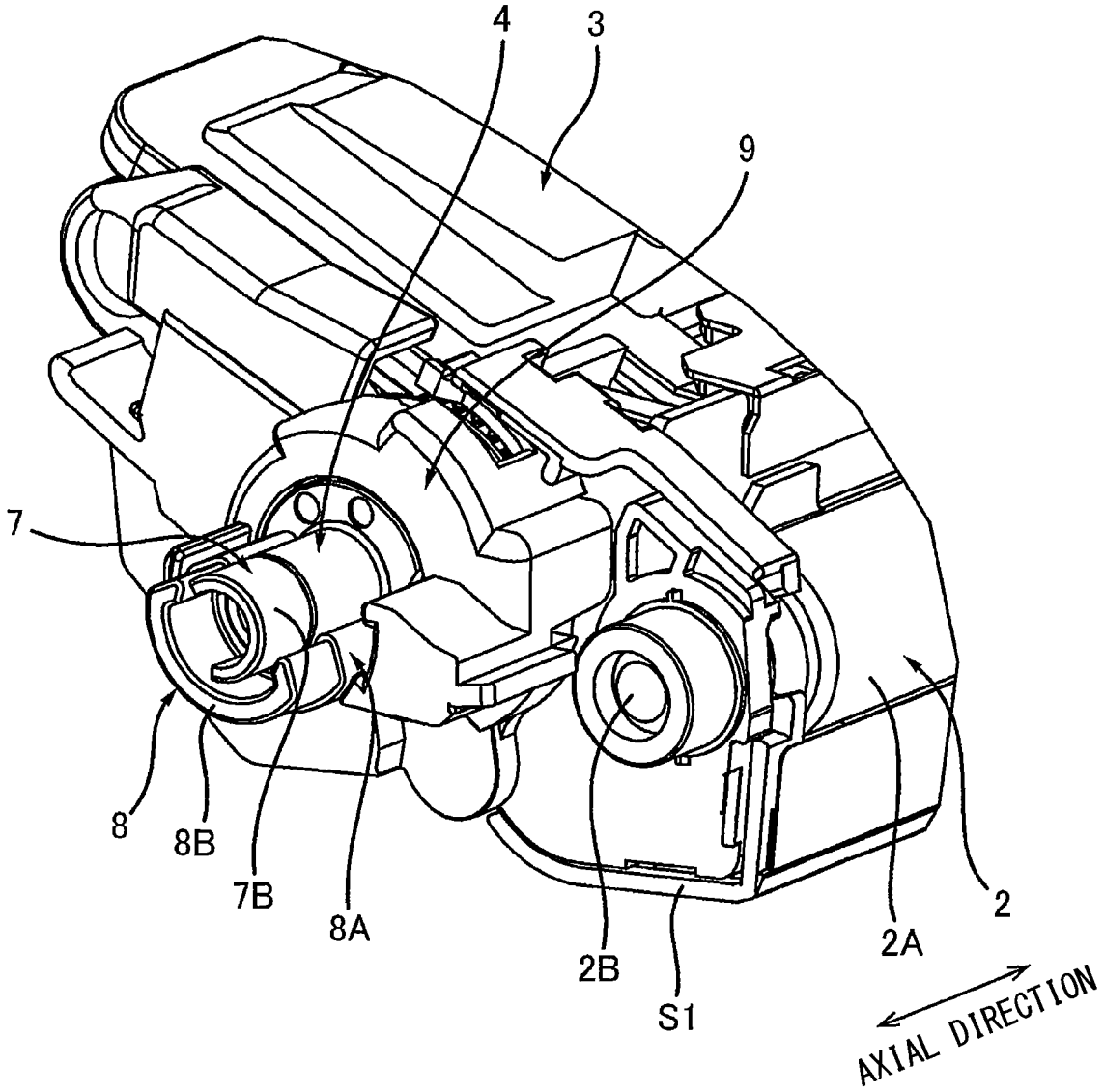
FIG. 2 is an enlarged perspective view illustrating an end portion of the developing cartridge according to the embodiment.

As illustrated in FIGS. 2 and 3, the adapter 7 is attached to the free end portion 4A of the electrode 4 and extends in the axial direction. The adapter 7 provides electric conductivity. The adapter 7 includes an attachment portion 7A and an extension portion 7B.

The attachment portion 7A is fitted with the free end portion 4A of the electrode 4 and positioned at an internal space of the electrode 4 in a state of attachment of the adapter 7 to the electrode 4. In this state, the attachment portion 7A is in contact with an inner peripheral surface of the electrode 4, so that the adapter 7 is electrically connected to the electrode 4. Preferably, an electrically conductive grease is applied between the adapter 7 and the electrode 4, ensuring electrical contact therebetween.

The extension portion 7B extends from the free end portion 4A of the electrode 4 in the state of attachment of the adapter 7 to the electrode 4. Thus, a total length L2 of the electrode 4 and the adapter 7 in the axial direction in the attaching state of the adapter 7 to the electrode 4 is greater than a length L1 of the electrode 4 in the axial direction in the state where the adapter 7 is detached from the electrode 4 as illustrated in FIGS. 4A and 4B. Therefore, the adapter 7 can be in contact with the second main electrode 100B in a case of attachment of the developing cartridge 1 attached with the adapter 7 to the second type of image forming apparatus. Because of the contact of the adapter 7 with the second main electrode 100B, electric power from the second main electrode 100B of the second type of image forming apparatus can be supplied to the electrode 4 through the adapter 7.

1.9 Second Adapter 8

Figure 5B:
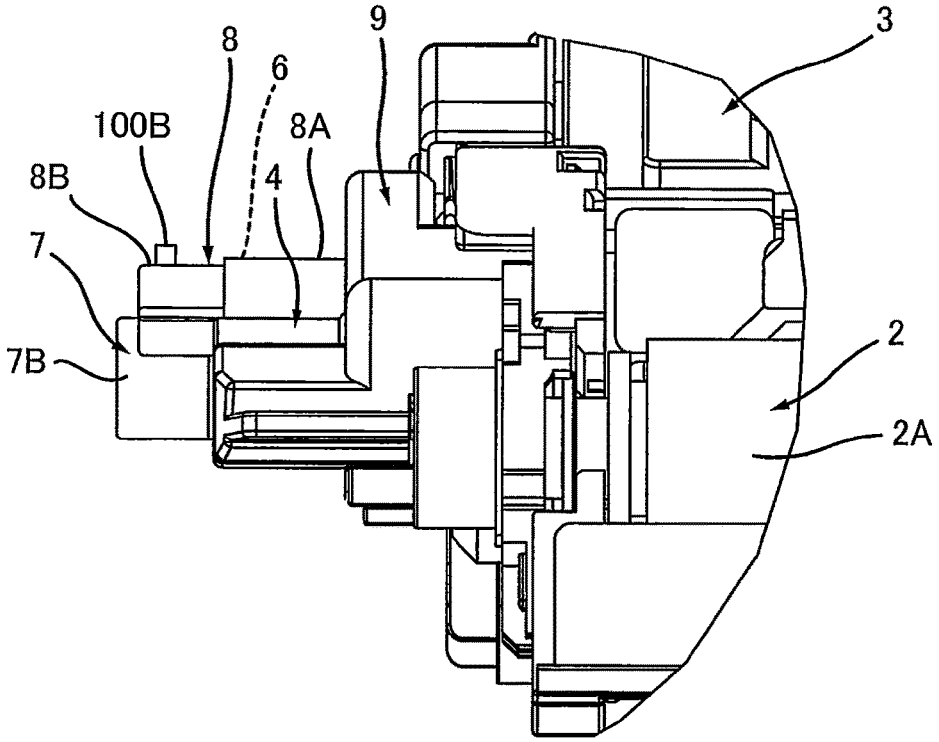
FIG. 5B is a view illustrating a state where the second adapter 8 is rotated about the adapter 7 in accordance with the rotation of the protrusion 6 in the developing cartridge illustrated in FIG. 4B.

As illustrated in FIGS. 4B and 5B, the second adapter 8 is a component in contact with the second main electrode 100B of the second type of image forming apparatus when developing cartridge 1 is attached to the second type of image forming apparatus and the second adapter 8 is rotated together with the protrusion 6.

The second adapter 8 is attached to the protrusion 6 and extends in the axial direction. The second adapter 8 is rotatable together with the protrusion 6 in a state of attachment of the second adapter 8 to the protrusion 6. The second adapter 8 includes an attachment portion 8A and an extension portion 8B.

The attachment portion 8A is fitted with the tip end portion 6B of the protrusion 6 and covers the tip end portion 6B in the state of attachment of the second adapter 8 to the protrusion 6.

The extension portion 8B extends from the attachment portion 8A in the axial direction. Thus, a second total length L12 of the protrusion 6 and the second adapter 8 in the axial direction in the attaching state of the second adapter 8 to the protrusion 6 is greater than a length L11 of the protrusion 6 in the axial direction in the state where the second adapter 8 is detached from the protrusion 6 as illustrated in FIGS. 4A and 4B. Therefore, the second adapter 8 can be in contact with the second main electrode 100B in a case where the developing cartridge 1 is attached to the second type of image forming apparatus in the state where the second adapter 8 is attached to the protrusion 6, because of the rotation of the protrusion 6 causing rotation of the second adapter 8 about the adapter 7. Since the second adapter 8 is brought into contact with the second main electrode 100B, the second main electrode 100B moves from the position illustrated in FIG. 4B to the position illustrated in FIG. 5B. Movement of the second main electrode 100B is detected by a sensor (not illustrated) positioned inside the second type of image forming apparatus. The second type of image forming apparatus determines information on the developing cartridge 1 on a basis of a signal pattern transmitted from the sensor.

1.10 Gear Cover 9

As illustrated in FIGS. 2 and 3, the gear cover 9 is positioned at the outer surface S1, and is attached thereto. The gear cover 9 covers at least a part of the gear 5. The gear cover 9 has an opening 9A through which the electrode 4 and the protrusion 6 extend. In the state of the attachment of the adapter 7 to the electrode 4, the adapter 7 is exposed to the outside through the opening 9A. Further, in the state of the attachment of the second adapter 8 to the protrusion 6, the second adapter 8 is exposed to the outside through the opening 9A.

2. Using Mode of Developing Cartridge 1

As illustrated in FIG. 4A, to attach the developing cartridge 1 to the first type of image forming apparatus, a user detaches the adapter 7 and the second adapter 8 from the electrode 4 and the protrusion 6, respectively. Further, as illustrated in FIG. 4B, to attach the developing cartridge 1 to the second type of image forming apparatus, the user attaches the adapter 7 and the second adapter 8 to the electrode 4 and the protrusion 6, respectively.

As illustrated in FIG. 2, in the state where the adapter 7 is attached to the electrode 4, the adapter 7 is exposed to the outside through the opening 9A, and further, in the state where the second adapter 8 is attached to the protrusion 6, the second adapter 8 is exposed to the outside through the opening 9A.

In other words, the user can attach the adapter 7 to the electrode 4 and can attach the second adapter 8 to the protrusion 6 through the opening 9A without removing the gear cover 9.

As illustrated in FIG. 4A, upon attachment of the developing cartridge 1 where the adapter 7 is removed from the electrode 4 to the first type of image forming apparatus, the electrode 4 is in contact with the first main electrode 100A. Further, as illustrated in FIG. 4B, upon attachment of the developing cartridge 1 where the adapter 7 is attached to the electrode 4 to the second type of image forming apparatus, the adapter 7 is in contact with the second main electrode 100B.

Hence, the developing cartridge 1 is compatible with the first type of image forming apparatus and the second type of image forming apparatus having specifications different from each other.

3. Function and Effect

The developing cartridge 1 can be attached to the first type of image forming apparatus at a position capable of allowing the electrode 4 to be at a position corresponding to the position of the axial length L1, i. e. capable of allowing the electrode 4 to be in contact with the first main electrode 100A by detaching the adapter 7 from the electrode 4 as illustrated in FIG. 4A.

Further, the developing cartridge 1 can be attached to the second type of image forming apparatus at a position capable of allowing the electrode 4 and adapter 7 to be at a position corresponding to the position of the total length L2 in the axial direction by attaching the adapter 7 to the electrode 4 as illustrated in FIG. 4B.

Thus, the developing cartridge 1 can be attached to both the first type of image forming apparatus and the second type of image forming apparatus.

4. Modifications

In a case where the developing cartridge 1 is boxed with the adapter 7 and the second adapter 8 being detached from the electrode 4 and the protrusion 6, respectively, the user attaches the developing cartridge 1 to the first type of image forming apparatus while the adapter 7 and the second adapter 8 remain detached. Alternatively, the user attaches the developing cartridge 1 to the second type of image forming apparatus after the adapter 7 and the second adapter 8 are attached to the electrode 4 and the protrusion 6, respectively.

In a case where the developing cartridge 1 is boxed with the adapter 7 and the second adapter 8 being attached to the electrode 4 and the protrusion 6, respectively, the user attaches the developing cartridge 1 to the first type of image forming apparatus after the adapter 7 and the second adapter 8 are detached from the electrode 4 and the protrusion 6, respectively. Alternatively, the user attaches the developing cartridge 1 to the second type of image forming apparatus while the adapter 7 and the second adapter 8 remain attached to the electrode 4 and the protrusion 6, respectively.

The second adapter 8 is not necessarily required in the developing cartridge 1. In a case where such a developing cartridge 1 provided with the adapter 7 but not provided with the second adapter 8 is attached to the second type of image forming apparatus, the developing cartridge 1 can be operated by receiving electric power from the second type of image forming apparatus through the adapter 7. The second type of image forming apparatus can determine information on the developing cartridge 1 on a basis of a signal pattern in a case where movement of the second main electrode 100B is not detected.

While the description has been made in detail with reference to the embodiments thereof, it would be apparent to those skilled in the art that many modifications and variations may be made therein without departing from the spirit of the disclosure.

What is claimed is:

1. A developing cartridge comprising:

a developing roller rotatable about a first axis extending in an axial direction of the developing roller;

a casing configured to accommodate therein toner, the casing having an outer surface positioned at one end of the casing in the axial direction;

an electrode electrically connected to the developing roller and positioned at the outer surface, the electrode extending in the axial direction;

a gear rotatable about the electrode;

a protrusion protruding in the axial direction and rotatable together with the gear; and an adapter having an electric conductivity and detachably attachable to the electrode, the adapter being electrically connected to the electrode in a state where the adapter is attached to the electrode, wherein a total length of the electrode and the adapter in the axial direction in the state where the adapter is attached to the electrode is greater than a length in the axial direction of the electrode in a state where the adapter is detached from the electrode.

2. The developing cartridge according to claim 1, further comprising a second adapter detachably attachable to the protrusion, the second adapter being rotatable together with the protrusion in a state where the second adapter is attached to the protrusion, wherein a second total length of the protrusion and the second adapter in the axial direction in the state where the second adapter is attached to the protrusion is greater than a second length in the axial direction of the protrusion in a state where the second adapter is detached from the protrusion.

3. The developing cartridge according to claim 1, further comprising a grease interposed between the adapter and the electrode.

4. The developing cartridge according to claim 1, further comprising a gear cover covering at least a part of the gear, the gear cover having an opening, wherein the adapter is exposed to an outside through the opening in the state where the adapter is attached to the electrode.

5. The developing cartridge according to claim 1, wherein the electrode is configured to contact with a first main electrode of a first type of image forming apparatus in a state where the developing cartridge is attached to the first type of image forming apparatus with the state where the adapter is detached from the electrode, and wherein the adapter is configured to contact with a second main electrode of a second type of image forming apparatus in a state where the developing cartridge is attached to the second type of image forming apparatus with the state where the adapter is attached to the electrode.

6. A developing cartridge comprising:

a main portion comprising:

a developing roller rotatable about a first axis extending in an axial direction of the developing roller;

a casing configured to accommodate therein toner, the casing having an outer surface positioned at one end of the casing in the axial direction;

an electrode electrically connected to the developing roller and positioned at the outer surface, the electrode extending in the axial direction;

a gear rotatable about the electrode; and a protrusion protruding in the axial direction and rotatable together with the gear; and an adapter having an electric conductivity and detachably attachable to the electrode, the adapter being electrically connected to the electrode in a state where the adapter is attached to the electrode, wherein a total length of the electrode and the adapter in the axial direction in the state where the adapter is attached to the electrode is greater than a length in the axial direction of the electrode in a state where the adapter is detached from the electrode; and wherein the adapter is detached from the electrode to attach the main portion to a first type of image forming apparatus, and the adapter is attached to the electrode to attach the main portion to a second type of image forming apparatus.

* * * * *